United States Patent [19]

Kumpf et al.

[11] 4,003,281

[45] Jan. 18, 1977

[54] RECORD MATERIAL CUTTING MECHANISM

[75] Inventors: Sherman S. Kumpf, Dryden; Robert W. Flood, Interlaken, both of N.Y.

[73] Assignee: NCR Corporation, Dayton, Ohio

[22] Filed: June 10, 1975

[21] Appl. No.: 585,726

[52] U.S. Cl. ..... 83/477.2; 83/487; 83/508

[51] Int. Cl.[2] ..... B26D 1/16; B26D 1/20

[58] Field of Search ..... 83/483, 487, 488, 490, 83/471.2, 477.2, 508, 614

[56] References Cited

UNITED STATES PATENTS

| | | | |
|---|---|---|---|
| 344,568 | 6/1886 | Collins | 83/477.2 X |
| 355,589 | 1/1887 | Collins | 83/477.2 X |
| 2,551,811 | 5/1951 | Mueller | 83/487 X |
| 2,572,757 | 10/1951 | Powell et al. | 83/487 |
| 2,699,372 | 1/1955 | Mosler | 83/487 X |
| 3,344,819 | 10/1967 | Mitchell | 83/477.2 X |

*Primary Examiner*—Frank T. Yost
*Attorney, Agent, or Firm*—J. T. Cavender; Wilbert Hawk, Jr.; Richard W. Lavin

[57] ABSTRACT

A cut-off mechanism for severing a record member in a data terminal device is disclosed which includes a cutting wheel mounted on a pivoted support arm member which is so mounted that when rocked about its pivot by an actuating member such arm member moves the cutting wheel in a rectilinear plane along a guide member to cut across the record member. The support arm member is pivoted on a stud positioned within an arm member slot which allows the arm member to move in a vertical direction as the cutting wheel traverses the record member. Provisions are made to change the position of the pivot point of the arm member and the actuating member to vary the length of the cutting stroke of the cutting wheel allowing for partial cuts of the record member to be made.

19 Claims, 5 Drawing Figures

RECORD MATERIAL CUTTING MECHANISM

FIELD OF THE INVENTION

This invention relates to cutting devices, and more particularly to a paper strip cutting wheel which includes a mechanism for driving the cutting wheel.

BACKGROUND OF THE INVENTION

In present day merchandising operations wherein electronic cash registers or data terminal devices are utilized to calculate the amount due and paid, a copy of the transaction in the form of a printed receipt is produced and given to the customer. Prior mechanisms which have been used for cutting the receipt include perforating a row of holes across the receipt or incorporating a knife member pivoted at one edge of the strip of receipt paper and actuated to cut across the strip, thereby severing the printed receipt from the strip. These mechanisms have been found to have inherent defects which detract against their use. In the case of perforating a line of holes across the receipt, large amounts of paper dust are created which tend to settle within the various mechanisms of the terminal device, thereby causing mis-operation of the mechanism. In the case of the pivoted knife mechanism, it has been found that the mechanism requires frequent adjustments to provide the proper shearing action of the blade so as to insure a good cut of the receipt strip. It is therefore an object of this invention to provide a paper strip cutting mechanism for use in a data terminal device which is positive in its cutting action and reliable in its operation. It is a further object of this invention to provide a paper strip cutting mechanism which is simple in its construction and therefore low in cost.

SUMMARY OF THE INVENTION

In order to carry out these objects, there is provided a cutting wheel rotatably supported on a knife arm slidably pivoted on a support stud. A cam member positioned within a slot in the knife arm is moved in a circular direction by a drive member thereby oscillating the knife arm about the stud. The stud is positioned within a second slot in the knife arm, such that as the knife arm is oscillated, the stud will ride in the second slot along the length of the knife arm in such a manner as to allow the knife arm to move in a generally vertical direction which moves the cutting wheel in a plane across the record member, thereby severing the record member. The cutting wheel is spring urged against a shearing surface as it moves along its cutting path to provide a positive cutting action. Sensing means are provided to control the operation of the drive member so that the knife arm will be oscillated through one cutting cycle. There is also provided a support guide member coacting with a spring urged roller member for supporting and guiding the cutting wheel along a predetermined cutting path, the support guide member including a wedge portion for stopping and holding the cutting wheel in its home position.

The foregoing and other objects, features and advantages of the invention will be apparent from the following detailed description, taken in conjunction with the accompanying drawing.

DESCRIPTION OF THE PREFERRED EMBODIMENT

Figure 1:
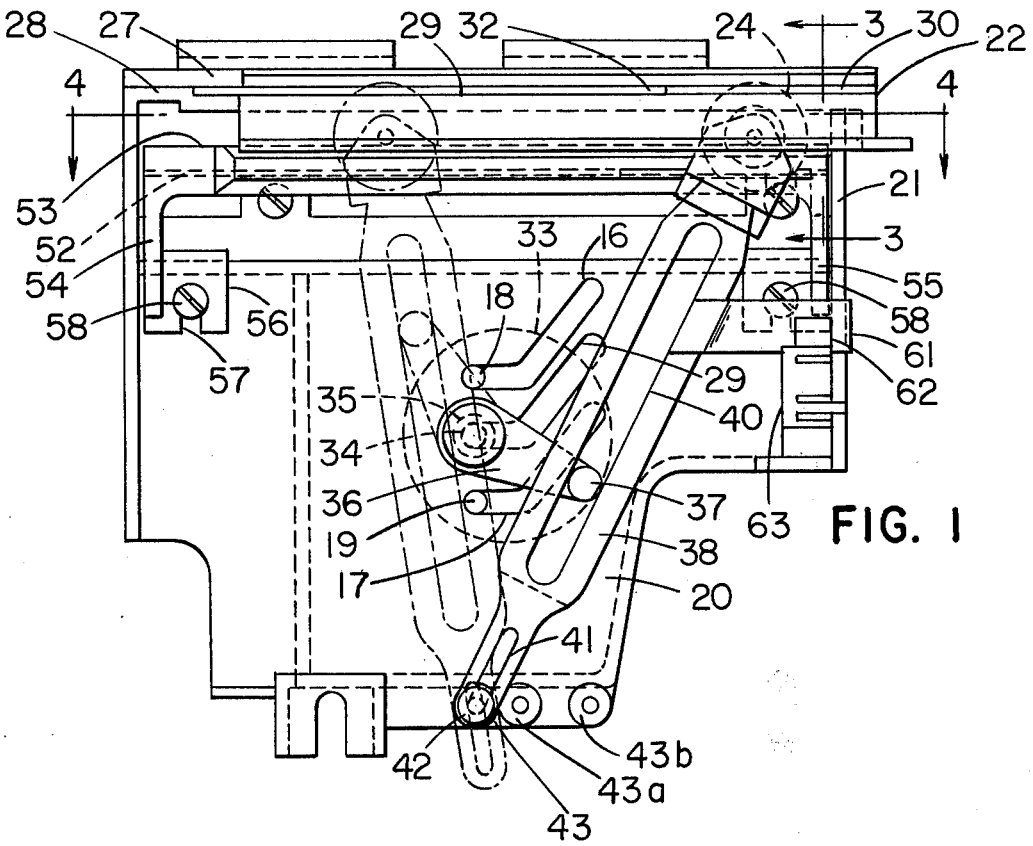
FIG. 1 is a front elevational view of the cutting mechanism showing the knife arm in the home position and also in a position approaching the cutting movement.
Figure 2:
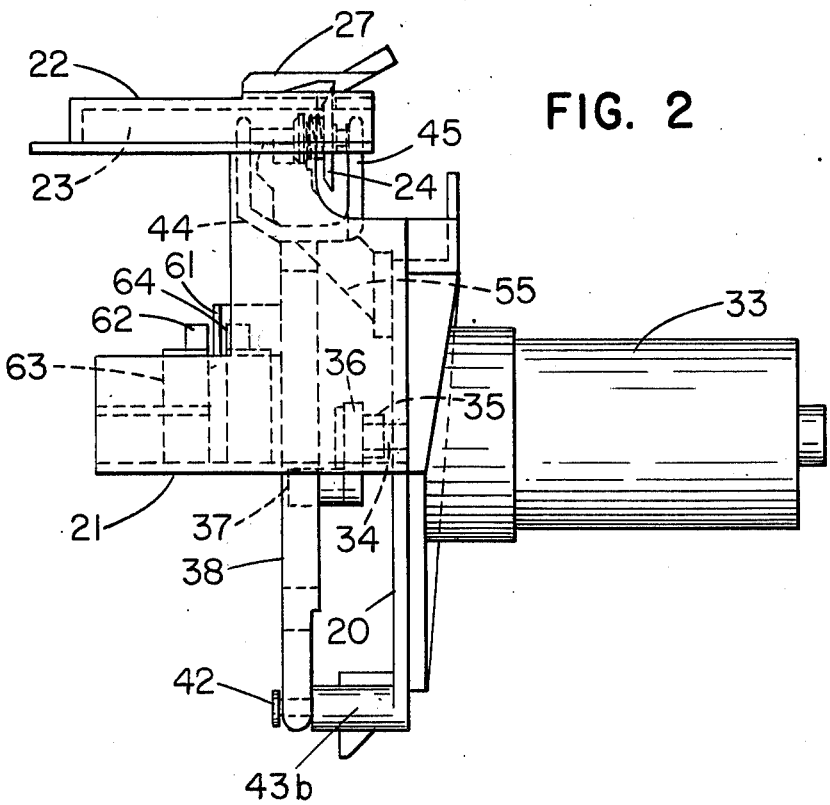
FIG. 2 is a side elevational view of the cutting mechanism.
Figure 3:
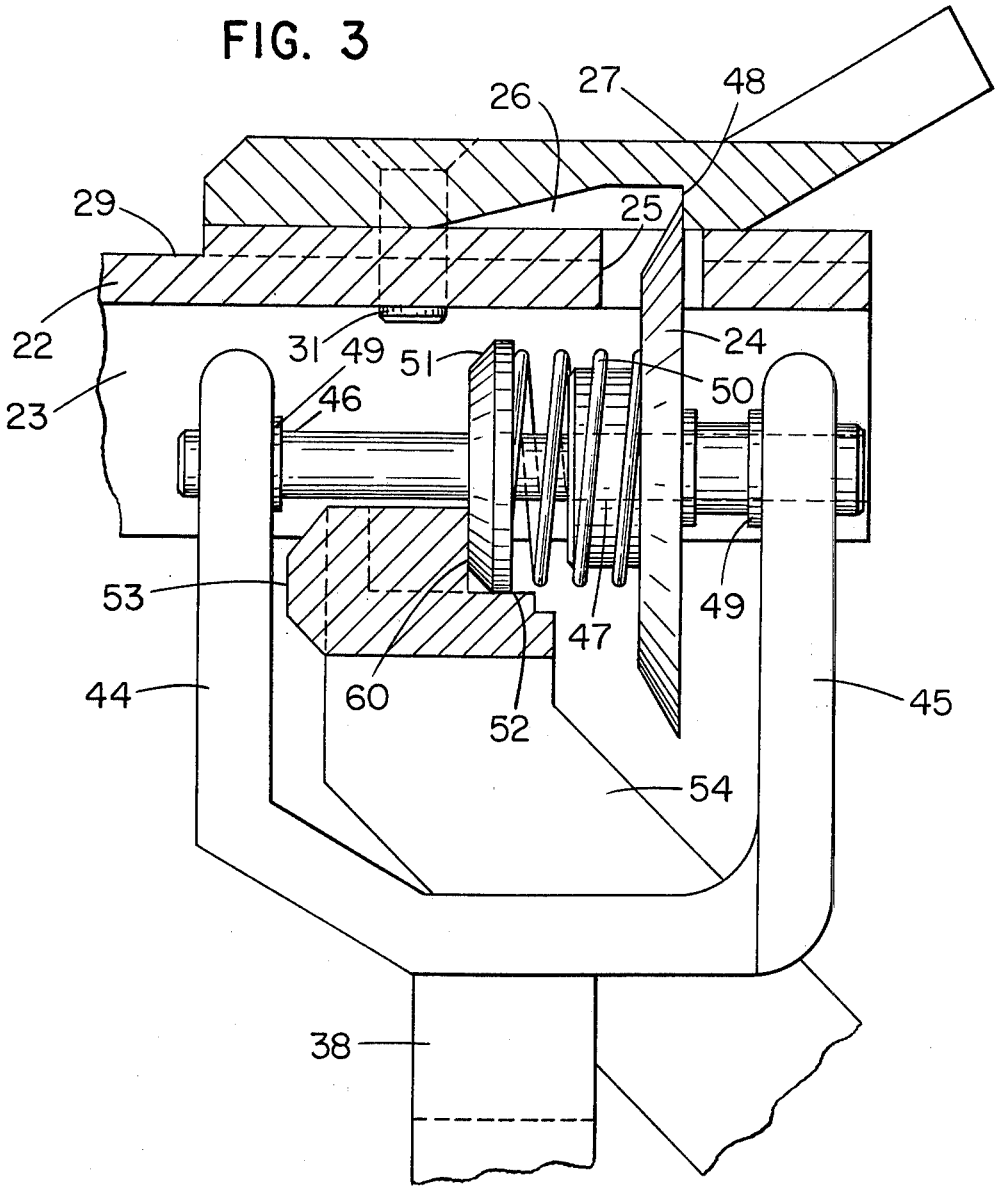
FIG. 3 is a sectional view taken on lines 3—3 of FIG. 1 showing on an enlarged scale details of the cutting wheel in its home position on the support guide.

Referring now to the drawings, FIG. 1 shows a front view of the cutting mechanism of the present embodiment which can be mounted within a data terminal device. Included in the mechanism is a knife bracket 20 having an extension 21 (FIG. 2) projecting forwardly from the main body of the bracket and an overhang portion 22 extending outwardly from the top of the bracket forming a recessed area 23 within which is positioned a cutting wheel 24 (FIG. 2). The upper portion of the cutting wheel 24 projects through a slot 25 (FIG. 3) located in the top surface 29 of the overhang portion 22 and into a recessed area 26 of a plate 27 mounted on a pair of raised portions 28, 30 (FIG. 1) of the overhang 22 by some suitable fastening means such as rivets 31 or push-on clips (FIG. 3). As best seen in FIG. 1, the plate 27 forms a slot 32 with the top surface 29 of the overhang portion 22, through which slot a record member strip, being in the present case a strip of receipt paper, extends so as to be severed by the movement of the cutting wheel 24 during operation of the terminal device.

Secured to the rear side of the knife bracket 20 by any suitable means such as screws 18, 19 (FIG. 1), which are mounted in adjustment slots 16, 17, respectively, is a motor 33 (FIG. 2) whose drive shaft 34 extends through a further adjustment slot 29 to the front side of the bracket 20, and to which is secured a hub 35 (FIG. 2). As shown in FIG. 1, affixed to the hub 35 is a cam arm member 36 which supports on its end a stud 37. Operatively associated with the arm member 36 is a knife arm 38 which includes a longitudinal slot 40 within which is positioned the stud 37. As shown more clearly in FIG. 1, the knife arm 38 has a second longitudinal slot 41 within which is positioned a stud 42 removably mounted in one of three raised bosses **43, 43*a* and 43*b* located on the lower front side of the knife bracket 20. As understood from FIG. 1, upon operation of the motor 33, the arm member 36 will be rotated about the shaft 34 allowing the stud 37 to rock the knife arm 38 about the stud 42 while sliding along the slot 40 as shown in dotted lines in FIG. 1. It is obvious that the extent of rocking of the knife arm 38 by the motor 33 is determined by the location of the stud 41 in one of the bosses 43, 43*a*, 43*b* and the position of the motor shaft 34 within the adjustment slot 29. Thus, when the stud 42 is positioned in the boss 43 and the motor 33 is positioned in the left portion of the slot 29, as viewed in FIG. 1, the knife arm will be rotated through its longest arc by the motor 33 to provide a full cut of the receipt strip. On the other hand, mounting the stud 42 in either of the other two bosses 43***a*, 43*b* together with moving the motor to the right within adjustment slot 29 will provide for partial cuts of the receipt strip.

As best seen in FIGS. 2 and 3, the top portion of the knife arm 38 consists of a pair of yoke extensions 44, 45 between which is rotatably mounted a shaft 46. The shaft 46 is suitably mounted in the yoke extensions by means of clips 49 or the like which rotate with the shaft. Associated with the shaft 46 is the cutting wheel 24 rotatably and slidably mounted thereon and to which is secured a hub 47. As described previously, the cutting wheel 24 extends through the slot 25 in the top of the knife bracket overhang portion 22 into the recessed area 26 of the top plate 27. As shown in FIG. 3, the cutting wheel 24 is moved into engagement with a shear edge 48 of the recessed area 26 by the action of a compression spring 50 positioned on the hub 47 and mounted between the cutting wheel 24 and a guide roller 51 rotatably mounted on the shaft 46.

Figure 4:
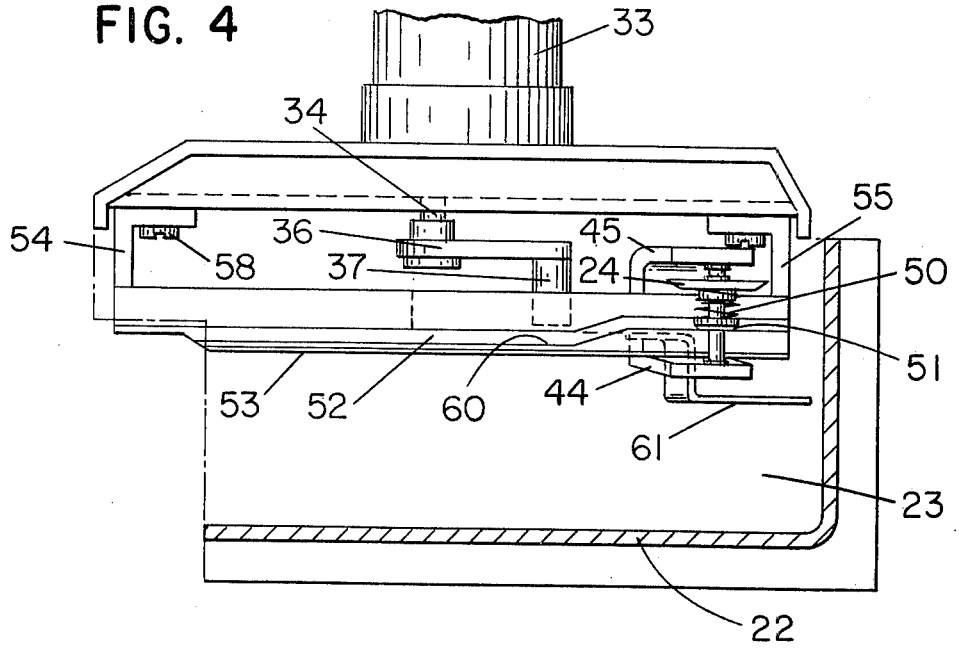
FIG. 4 is a partial sectional view taken on line 4—4 of FIG. 2 showing details of the wedge portion of the support guide member.

As best understood from FIGS. 3 and 4 inclusive, the roller 51 is positioned to ride on a horizontal surface 52 of a ledge or guide support 53 extending across the top of the knife bracket 20 and which supports the roller 51, cutting wheel 24 and the knife arm 38. The guide support 53 has a pair of depending arm members 54, 55 (FIG. 1), each having a bracket portion 56 containing a slot 57 which is slipped over some suitable support member such as a screw 58 or the like mounted in the knife bracket 20. This arrangement allows the guide support 53 to be adjusted in a vertical direction by positioning the brackets 56 on the screws 58 to level the guide support.

best seen in FIGS. 3 and 4, the guide support 53 has a cam surface 60 which functions as a guide against which the roller 52 is urged by the action of the spring 50. Movement of the knife arm 38 results in the roller rolling on the surface 52 and along the cam surface 60 of the guide support guiding the cutting wheel 24 in a horizontal direction to transverse the receipt strip in a cutting movement. As seen in FIG. 4, the right hand portion of the cam surface 60 angles inwardly towards the rear of the knife bracket forming a wedge portion which moves the washer 51 against the spring 50 as the knife arm 38 moves into its home position. When this occurs the spring 50 will be further compressed, thus wedging the roller 51 against the cam surface 60 and the cutting wheel 24 against the shearing surface 48 of the top plate 27 so as to hold the arm in the home position.

The knife arm 38 has a right hand extension 61 (FIG. 1) which coacts with a photo-electric cell 62 (FIG. 2) mounted on a bracket 63 secured to the forward extension 21 of the bracket 20. A light source 64 (FIG. 2) is also mounted on the bracket 63 and operates in conjunction with the photo-electric cell 62 in a manner well known in the art to generate a control signal for use in controlling the operation of the motor 33 in accordance with the position of the knife arm 38 as will be described more fully hereinafter.

In the operation of the cutting mechanism in accordance with the invention, the data terminal device will have been operated to print data on the receipt strip positioned on the surface 29 of the knife bracket 20 and located within the slot 32 (FIG. 1). After the printing operation has occurred and the receipt strip moved to the proper position, the motor 33 will be energized to rotate the arm 36 and the knife arm 38 counterclockwise as viewed in FIG. 1. Since the knife arm 38 is slidably mounted with respect to the stud 37 secured to the cam arm 36 and likewise slidably mounted on the pivot stud 42, rocking of the knife arm 38 will result in the knife arm simultaneously sliding in a downward direction on the pivot stud 42 due to the weight of the arm 38 together with the roller 51 and the cutting wheel 24. This downward movement of the arm 38 will allow the roller 51 to move along the surface 52 of the guide plate 53 in a horizontal direction. Due to the friction between the roller 51 and the cam surface 60 of the guide support caused by the action of the spring 50, movement of the arm 38 will result in the rotation of the roller 51 as it moves along the guide plate 53. In a similar manner, friction between the edge of the cutting wheel 24 and the shear edge 48 of the top plate 27, in addition to the friction between the cutting wheel and the receipt strip, will result in the rotation of the cutting wheel 24 in a clockwise direction as viewed in FIG. 1. This rotation of the cutting wheel will sever the receipt strip.

As the knife arm 38 is rocked back towards its home position, the roller 51 will be moved into the wedge portion of the guide plate 53 (FIG. 4) where the spring 50 will be compressed, thereby exerting a greater force on both the roller 51 and the cutting wheel 24. Movement of the knife arm 38 into its home position as shown in solid lines in FIG. 1 will result in the extension 61 of the knife arm 38 blocking the light from the light source 64 so that the signal from photo-electric cell 62 upon the blocking of the light will stop the operation of the motor 33. Since at this time the roller 51 and the cutting wheel 24 are in the wedged portion of the guide plate 53, the arm 38 will be held in its home position and thus prevented from coasting out of the home position. As stated previously, if a partial cut of the receipt strip is desired, the pivot stud 42 will be positioned in one of the other raised bosses 43*a* and 43*b* and the motor shaft 34 moved to the proper position in the adjustment slot 29 depending on the length of cut desired.

Figure 5:
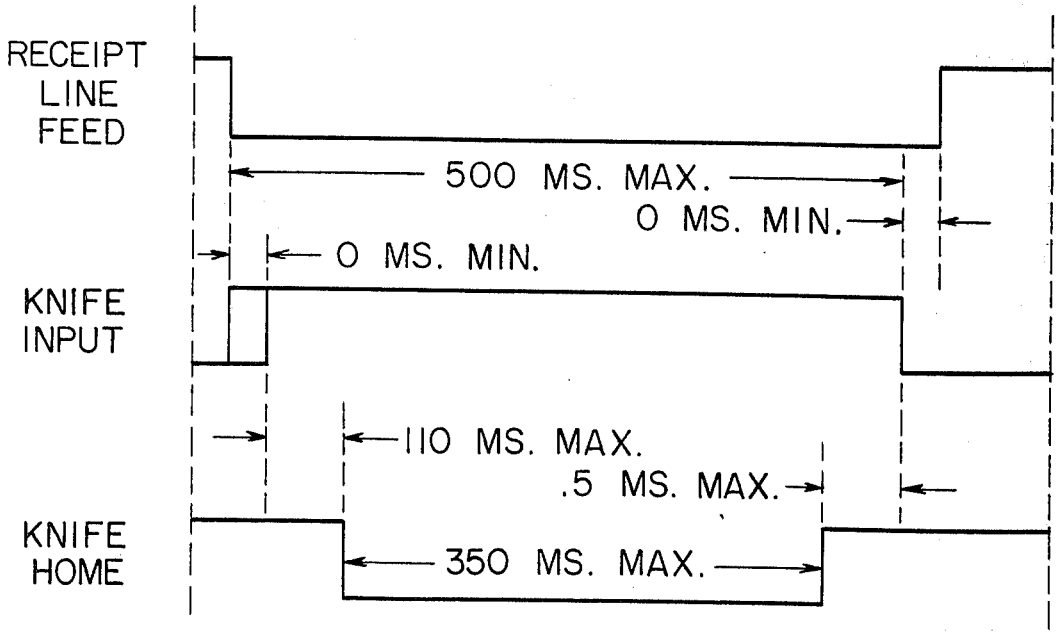
FIG. 5 is a diagrammatic representation of the timing of the operation of the cutting mechanism.

Referring now to FIG. 5, there is shown the timing of operation of the cutting mechanism. In the normal operation of the data terminal, the receipt strip will have been moved to a cutting position after the printing operation has occurred. When a Receipt Line Feed pulse generated within the data terminal is dropped (FIG. 5), a Knife Input pulse will be raised by the data terminal which pulse energizes the motor 33 — thus initiating rocking of the knife arm 38 in the manner described previously. As the knife arm 38 leaves the home position, the extension 61 will move away from the photo-cell 62 allowing the photo-cell to receive the light from the light source 64, thereby allowing the Knife Home signal to go false (FIG. 5). This will occur within 110 milliseconds after the start of rocking of the knife arm 38. Upon the arm 38 returning to the home position, the extension 61 will block the light from the source 64 resulting in the Knife Home signal going true. Within 0.5 of a millisecond (FIG. 5) after the Knife Home signal has gone true, the Knife Input signal will be dropped and thus deenergize the motor. As shown in FIG. 5, for purposes of motor protection the Knife Input signal will not last more than 500 milliseconds. Also, should the knife arm 38 not return to its home position with 500 milliseconds of its initial operation, a time-out circuit of conventional design is used to interrupt the operation of the data terminal so that the cause of the knife arm not returning to its home position can be eliminated.

While the principles of the invention have now been made clear in an illustrated embodiment, it will be obvious to those skilled in the art that many modifications of structure, arrangements, elements and components can be made which are particularly adapted for specific environments and operating requirements without departing from these principles. As an example, while the cutting surface has been shown in the disclosed embodiment to be in a horizontal plane, it is obvious that if the cutting surface is positioned in a vertical direction, the arm 38 would be required to be biased by a spring for movement in a direction away from the cutting surface to function in the manner set out above. Or a second guide surface could be provided forming a slot with the guide surface 52 to contain the roller 51 during its vertical movement. The appended claims are therefore intended to cover any such modification, within the limits only of the true spirit and scope of the invention.

What is claimed is:

1. In a data terminal device constructed and arranged to perform recording operations on a record member, a mechanism for severing a record member including:

a. a slotted supporting surface for supporting a record member in a cutting position;

b. a ledge support member extending along said supporting surface, said ledge support member having an upstanding guide surface;

c. a cutting surface extending along said slotted supporting surface and in a direction parallel to said guide surface;

d. an arm assembly engaging said ledge support member and operable for movement along said ledge support member;

e. a support member mounted on said arm assembly for movement into engagement with said guide surface and positioned on said ledge support member for supporting said arm assembly for movement along said ledge support member;

f. a cutting member mounted on said arm assembly for movement into engagement with said cutting surface and positioned within the slot, said cutting member cutting the strip of material when moved along said cutting surface;

g. resilient means engaging said support member and said cutting member for moving said support member into engagement with said guide surface to guide the arm assembly along said ledge support member and for moving the cutting member into engagement with said cutting surface;

h. and means for operating said arm assembly during a cutting operation whereby said arm assembly will be guided along the ledge support member to move the cutting wheel along said cutting surface to cut the strip of material.

2. Material cutting apparatus comprising:

a. support means extending in a direction transverse to a strip of material, said support means including a guide surface;

b. a cutting wheel engaging the strip of material to cut the strip of material when moved in a transverse direction, said cutting wheel mounted on said support means and engaging said guide surface;

c. pivot means;

d. means for moving said cutting wheel in a transverse direction including a support member engaging said cutting wheel and pivotally and slidably mounted on said pivot means, said support member sliding on said pivot means to move said cutting wheel along said support means when operated;

e. means for operating said support member;

f. a roller member mounted on said support member and positioned on said support means, said roller member engaging said guide surface to guide said support member and said cutting wheel in a direction to cut the strip of material;

g. and means engaging said roller member for urging said roller member into engagement with said guide surface whereby said support member and the cutting wheel will move in a direction to cut the strip of material when operated by said operating means.

3. An apparatus for cutting a strip of material comprising:

a. means for supporting a strip of material adjacent an elongated cutting surface;

b. cutting means mounted for reciprocal movement for a predetermined distance along said cutting surface;

c. an actuating member mounted on said supporting means in a plane generally perpendicular to the cutting surface, said actuating member having a first portion secured to said cutting means and movable therewith along said cutting surface and a second portion mounted on said supporting means for simultaneous rocking and translational movement;

d. and means engaging said actuating member intermediate said first and second portions for rocking said actuating member whereby said cutting means is reciprocally moved along said cutting surface by said actuating member to cut the strip of material.

4. The cutting apparatus of claim 3 in which said actuating member comprises an arm member having a slot therein and said rocking member comprises a rotary drive means having a connecting member slidably mounted within said slot whereby upon rotation of said drive means said connecting member will rock the arm member sliding the arm member in a direction generally perpendicular to the cutting surface to reciprocally move the cutting means along the cutting surface to cut the strip of material.

5. The cutting apparatus of claim 4 which includes a plurality of pivot means each mounted on said supporting means at a different distance from the mounting plane of the arm member to vary the length of movement of the cutting means along said cutting surface when positioned within the slot in said actuating arm.

6. Apparatus for cutting a strip of material comprising:

a. means for supporting a strip of material, said supporting means having a slot extending transverse to the strip of material;

b. a support member having a guide surface extending in a direction parallel to said slot;

c. an arm member positioned adjacent said support member and rotatably mounted for simultaneous movement in a direction parallel to and generally perpendicular to said support member;

d. a shaft member mounted on said arm member;

e. a cutting member mounted on said shaft member and positioned within said slot for cutting the strip of material when moved along said slot by said arm member;

f. a roller member rotatably mounted on said shaft member and engaging said guide surface to guide the cutting member along said slot;

g. and means for rotating said arm member whereby the arm member will move in a direction perpendicular to said support member to move the roller member along said support member and the cutting member within the slot to cut the strip of material.

7. The cutting apparatus of claim 6 which further includes a resilient member mounted on said shaft and engaging said roller member and said cutting member for simultaneously urging said roller member into engagement with said guide surface and the cutting member in engagement with the supporting means.

8. In a data terminal device constructed and arranged to perform a plurality of recording operations on a record member, a mechanism for selectively cutting across the record member including:

a. a slotted supporting surface for supporting a record member;

b. cutting means positioned on said supporting surface, said cutting means including a cutting member positioned within the slot;

c. an arm assembly having a slotted portion and mounted for translational movement along said supporting surface, said arm assembly engaging said cutting member;

d. a first pivot member positioned within said slotted portion;

e. and means for rotating said arm assembly about said pivot member whereby said pivot member will move along the slotted portion of the arm assembly allowing the arm assembly to move the cutting member in a horizontal direction along the slotted supporting surface to cut across the record member.

9. The cutting mechanism of claim 8 in which said arm assembly includes a second slotted portion, said rotating means includes a cam member positioned within said second slotted portion and a rotatable drive member engaging said cam member to rotate said cam member and said arm assembly whereby the cam member moves along said second slotted portion of the arm assembly during rotation of said arm assembly allowing the arm assembly to move in a direction generally perpendicular to said support member to move the cutting member along said support member.

10. The cutting mechanism of claim 9 in which said rotatable drive member is mounted in a first position with respect to the position of the pivot member to rotate said arm assembly through a first predetermined distance whereby the cutting member will cut the strip of material a first predetermined length.

11. The cutting mechanism of claim 10 which further includes a second pivot member, said drive member being mounted in a second position with respect to said first pivot member to rotate said assembly through a second predetermined distance when the arm assembly is mounted on said second pivot member whereby the cutting member will cut the strip of material a second predetermined length.

12. The cutting mechanism of claim 8 in which said arm assembly includes a yoke portion straddling the support member, and said cutting means includes a roller member rotatably mounted on said yoke portion and positioned on said support member to support said arm assembly for movement thereon.

13. The cutting mechanism of claim 12 in which said support member includes a guide surface extending along said support member, said roller member engaging said guide surface to guide said arm assembly along said support member.

14. The cutting mechanism of claim 12 in which said cutting means includes a shaft mounted in said yoke portion for slidably supporting said roller member and said cutting member, said cutting means further includes means mounted on said shaft and engaging said roller member into engagement with said guide surface to guide said cutting member along said slot.

15. The cutting mechanism of claim 14 which further includes a cutting surface located adjacent the slot, said urging means engaging said cutting member for urging said cutting member into engagement with said cutting surface whereby rotation of said arm assembly will move the cutting member along the cutting surface to cut the strip of material.

16. The cutting mechanism of claim 15 in which said urging means comprises a compressing spring mounted between said roller member and said cutting member to urge the roller member and the cutting member in opposite directions, a portion of said guide surface extending in a direction to move the roller member towards said cutting member whereby said compressing spring will be compressed to retard movement of said arm assembly.

17. In a data terminal device constructed and arranged to perform a plurality of recording operations on a record member, a mechanism for selectively cutting across the record member including:

a. means for supporting a record member in a cutting position;

b. cutting means mounted on said supporting means for movement thereon in a horizontal direction to cut the record member;

c. a first pivot member mounted on said supporting means;

d. a support member engaging said cutting means and mounted on said pivot member for simultaneous rotational and translational movement on said pivot member;

e. and means engaging said support member for rotating said support member whereby the support member will rotate and slide on the pivot member to move the cutting means in a horizontal direction.

18. The mechanism of claim 17 in which said support member comprises an arm member having one end slidably and rotatably mounted on said first pivot member and its other end extending in a plane generally perpendicular to said supporting means and engaging said cutting means, said rotating means engaging said arm member intermediate its ends whereby upon rotation of said arm member about said pivot member, said arm member will slide on said pivot member to move said cutting means along said supporting means.

19. The mechanism of claim 18 which includes a second pivot member mounted adjacent said first pivot member on said supporting means to vary the length of movement of said cutting means along said supporting means when pivotally secured to said arm member.

* * * * *